US005660595A

United States Patent [19]

Ferro, Jr. et al.

[11] Patent Number: 5,660,595

[45] Date of Patent: Aug. 26, 1997

[54] PORTABLE TRACK

[75] Inventors: Peter A. Ferro, Jr., Elwood; John C. Vande Velde, Lemont, both of Ill.; Robert J. Sutphen, Lowell, Ind.; Valere F. Vande Velde, Villa Park; Robert Jensen, Joliet, both of Ill.; Cecil R. Behringer, deceased, late of Edina, Minn.

[73] Assignee: F & V Sports Marketing, L.P., Lemont, Ill.

[21] Appl. No.: 322,944

[22] Filed: Oct. 12, 1994

(Under 37 CFR 1.47)

[51] Int. Cl.[6] ..... A63C 19/04

[52] U.S. Cl. ..... 472/92; 472/89

[58] Field of Search ..... 472/88, 89, 90, 472/92, 136, 85, 117; 238/10 R, 10 A, 10 E, 10 F; 404/1; 14/2.4

[56] References Cited

U.S. PATENT DOCUMENTS

| | | | |
|---|---|---|---|
| 437,887 | 10/1890 | Coop . | |
| 867,330 | 10/1907 | Young . | |
| 1,091,484 | 3/1914 | Cohn . | |
| 1,325,026 | 12/1919 | McCoy . | |
| 3,266,800 | 8/1966 | Yee . | |
| 3,284,819 | 11/1966 | Nissen . | |
| 3,810,706 | 5/1974 | Grimm et al. | 472/85 |
| 3,859,768 | 1/1975 | Donzis . | |
| 3,930,647 | 1/1976 | Berlemont . | |
| 4,285,514 | 8/1981 | Romero . | |
| 4,474,369 | 10/1984 | Gordon . | |
| 4,912,887 | 4/1990 | Sullivan . | |
| 5,020,286 | 6/1991 | Hamar et al. | 472/92 X |

*Primary Examiner*—Kien T. Nguyen
*Attorney, Agent, or Firm*—Wallenstein & Wagner, Ltd.

[57] ABSTRACT

The present invention provides a portable and expandable track or velodrome 10 for racing bicycles indoors and outdoors. The portable velodrome 10 includes a support structure network 18 that circumscribes an infield area 12 and a plurality of modular track surface sections 30 removably mounted on the support structure network 18 to form a banked track 22 having a racing surface. The modular track sections 30 are mounted on the support structure network 18 with track section mounting elements that do not interrupt the racing surface. The portable velodrome 10 further includes a substantially horizontal track section 28 extending from a bottom of the banked track 22 toward the infield area 12, and a transition surface between the banked track 22 and the horizontal track 28.

32 Claims, 7 Drawing Sheets

12
18
20
22
24
26
28
30
34
36
38
40
42
44
46
48
50
52
54
56
58
60
62
70
72
74
76
78
84
86
88
90
92
94
96
104
106

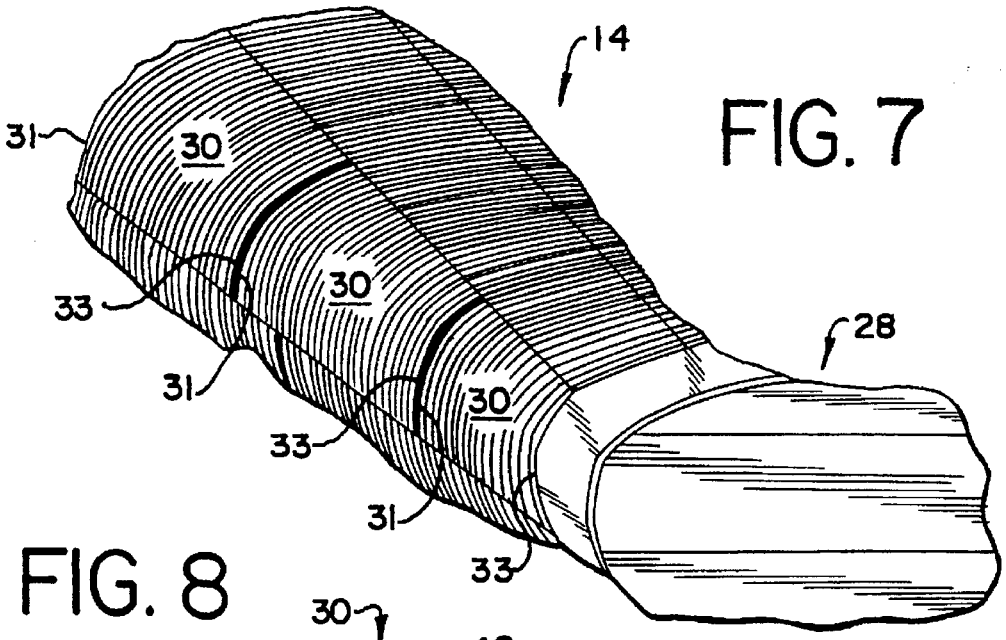
FIG. 7
FIG. 8
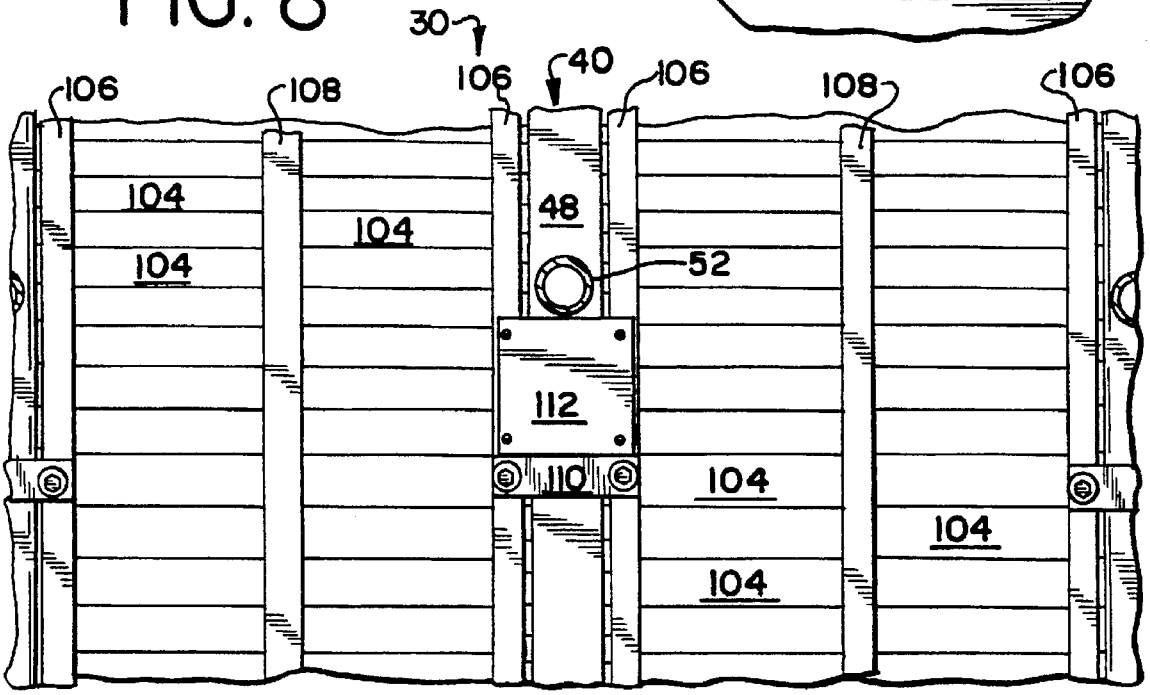
FIG. 9
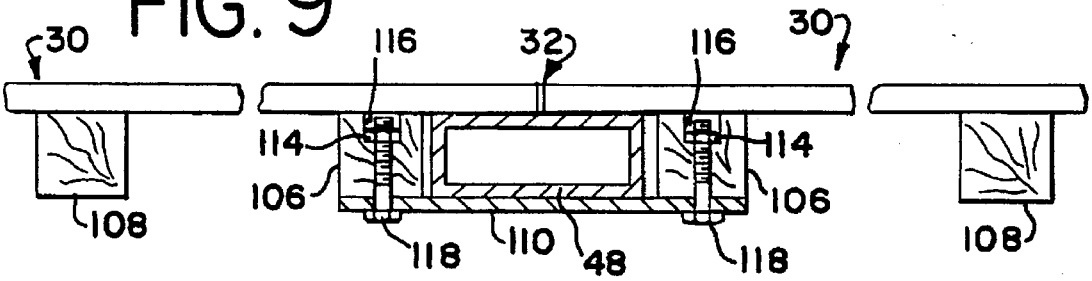

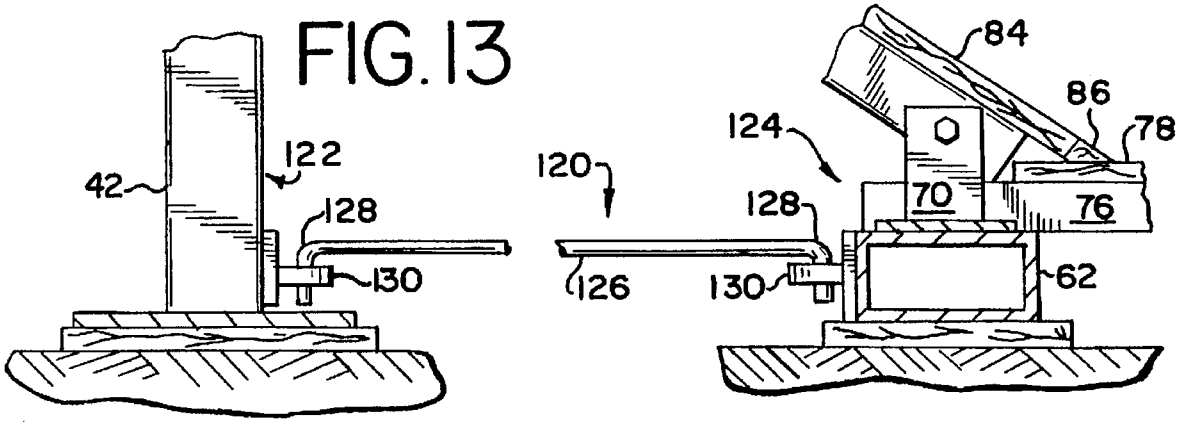
FIG. 13
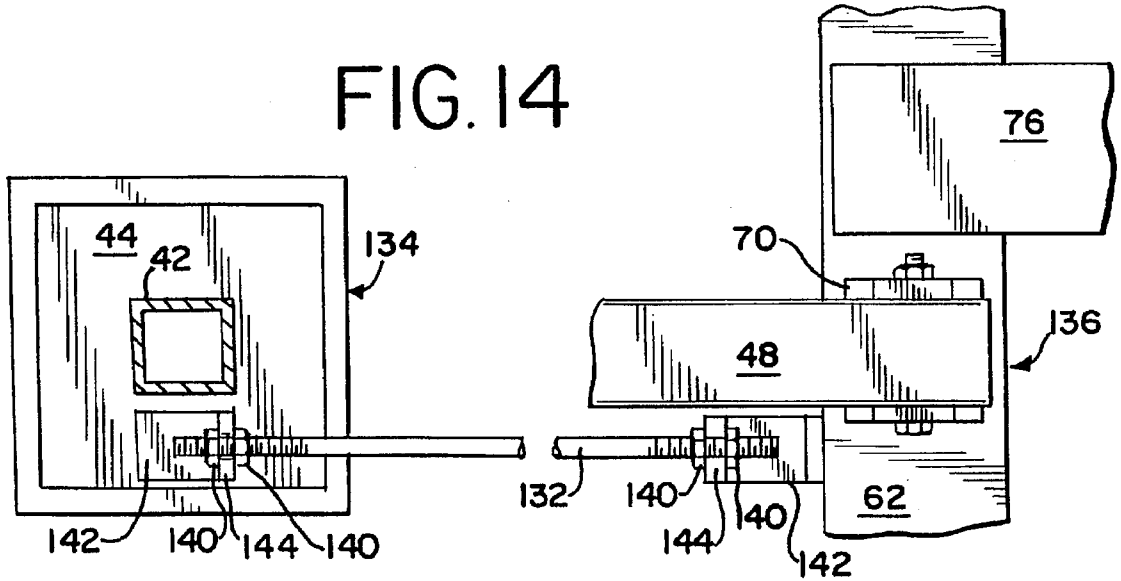
FIG. 14
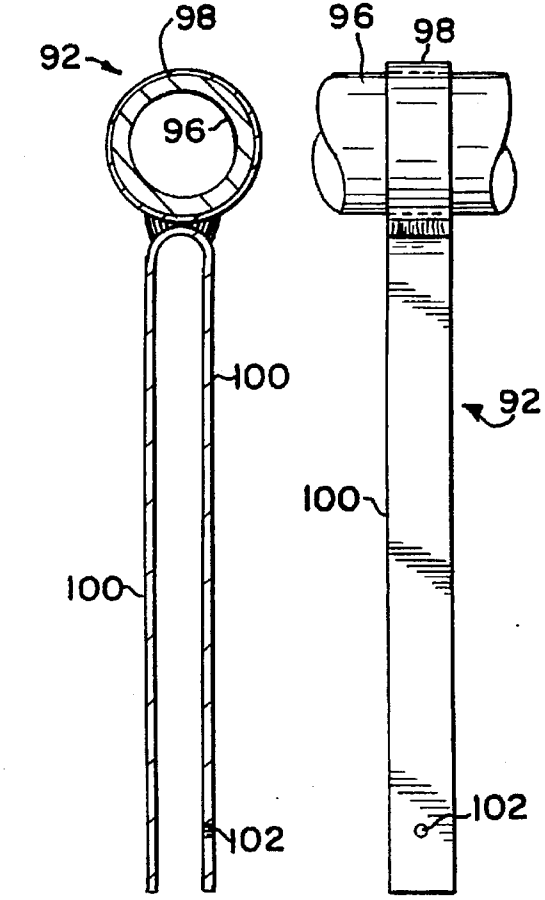
FIG. 12
FIG. 11

PORTABLE TRACK

BACKGROUND OF THE INVENTION

Bicycle riding and racing are well known and growing sports which appeal to a wide variety of participants and spectators. Bicycle riding provides healthy exercise and enjoyment for many participants and spectators. Further, the sport of bicycle racing provides a forum for exciting sports competition among various levels of athletes, including beginners, amateurs, and world-class bicycle racers. Bicycle races such as the Tour d' France and Olympic bicycling events have provided the sport of bicycle racing with international recognition.

Bicycle races can be conducted outdoors by designating a race course along existing streets or bicycle paths, for example. Bicycle races are also conducted outdoors or inside buildings by constructing bicycle racing tracks which are dedicated for bicycle racing. The bicycle racing tracks are generally circular or oval in shape with banked turns to allow bicycle racing in a confined area. Existing bicycle racing tracks have been permanently constructed; thus, a specific outdoor area or an entire building or section of a building must be dedicated for the bicycle race track. As permanent structures, bicycle racing tracks cannot be easily disassembled, transported to a new site, and reassembled. Bicycle race tracks are also quite large, expensive, and time consuming to build. Accordingly, bicycle race tracks have not been built in many areas.

Additionally, once a permanent bicycle race track is built, the size of the race track cannot be altered without extensive demolition and reconstruction of the race track and perhaps the building containing the track. Yet, various bicycle races may require or prefer a relatively longer or shorter race track. Also, various bicycle races may include participants that vary considerably in the degree of skill and ability to ride on a race track. A permanent race track must be extensively demolished and reconstructed to provide a relatively greater or lesser degree of banking.

However, as the interest and participation in bicycle racing flourishes, the demand for bicycle race tracks is increasing. Thus, a need exists for improving bicycle race tracks. Particularly, a need exists to improve bicycle race tracks by developing a portable, track that may be easily assembled and disassembled and modified. Such a portable track could also be used for sports other than bicycle racing, for example, roller skating, roller blading, dirt bike racing, go-cart racing, and motorcycling or other motorized vehicle racing. The present invention satisfies these and other needs to improve race tracks.

SUMMARY OF THE INVENTION

The present invention provides a portable and expandable track or velodrome for racing bicycles indoors and outdoors. The portable velodrome includes a support structure network that circumscribes an infield area and a plurality of modular track surface sections removably mounted on the support structure network to form a banked track having a racing surface. The modular track sections are mounted on the support structure network with track section mounting elements that do not interrupt the racing surface.

The portable velodrome further includes a substantially horizontal track section extending from a bottom of the banked track toward the infield area, and a transition surface between the banked track and the horizontal track.

BRIEF DESCRIPTION OF THE DRAWINGS

FIG. 7 is a perspective view of a turn of the velodrome of FIG. 1 showing curved track sections.

FIG. 8 is a back side view of a portion of a flat track section of the velodrome of FIG. 1.

FIG. 9 is a cross-sectional view of two flat track sections abutting one another and mounted on the support beam.

FIG. 11 is a front view of a hand rail clip.

FIG. 12 is a side view of the hand rail clip of FIG. 11.

FIG. 13 is side elevational view of a rod connected to an upright post assembly and an inner rail assembly in accordance with the principles of the present invention.

FIG. 14 is a top view of a rod connected to an upright post assembly and an inner rail assembly in accordance with the principles of the present invention.

DETAILED DESCRIPTION OF THE INVENTION

Although the present invention can be made in many different forms, the preferred embodiments are described in this disclosure and shown in the attached drawings. This disclosure exemplifies the principles of the present invention and does not limit the broad aspects of the invention only to the illustrated embodiments.

Figure 1:
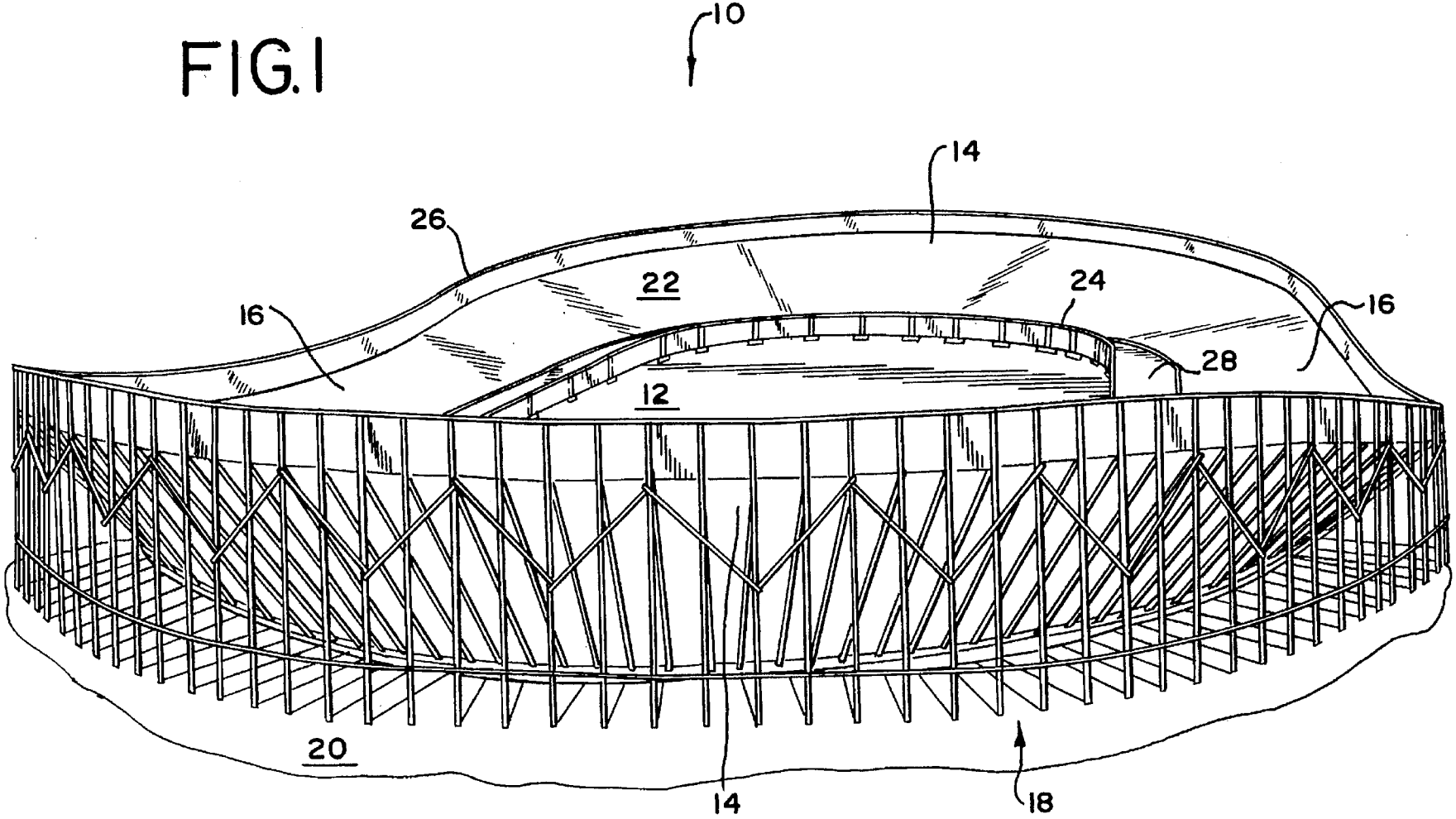
FIG. 1 is a perspective view of a velodrome made in accordance with the principles of the present invention.

FIG. 1 shows a perspective view of a portable velodrome 10 made in accordance with the principles of the present invention. The velodrome 10 is a banked track for racing bicycles and has a generally oblong circular shape which circumscribes an infield area 12. Of course, the velodrome 10 could be utilized for sports other than bicycle racing, such as roller skating and roller blading, for example. The portable velodrome 10 has two curved track ends 14 or turns connected by two straight track segments or straight-aways 16 which define the velodrome's 10 oblong circular shape. The straight-aways 16 may be increased or decreased in length as needed by adding or removing track sections (described below) and corresponding track section structural supports (described below). If the straight-aways 16 are completely removed, the velodrome 10 could have a circular shape. The present invention could also be used as a track that has a beginning and an end rather than a continuous circular type track. For example, a portion of the present invention could be used as a turn or straight-away in a dirt bike type race course.

The portable velodrome 10 includes a support structure network 18 placed on a substantially horizontal surface 20 and a racing track 22 is removably secured to the support structure network 18. The support structure network 18 circumscribes the infield area 12 to form an oblong or circular pattern and is inclined or banked. When the racing track 22 is mounted on the support structure network 18 the racing track 22 is facing upward and inward toward the infield area 12 at various angles. The banked racing track 22 allows bicycle racers to ride at a relatively high rate of speed on the velodrome 10, particularly through the turns 14. The banked straight-aways 16 facilitates transitions from the straight-aways 16 into the turns 14. Preferably, the portable velodrome 10 is banked approximately 52° in the turns 14 and approximately 13° in the straight-aways 16. However, the velodrome 10 may be banked at other angles or not banked at all.

An infield track wall 24 extends vertically upward and circumscribes the infield 12. The infield track wall 24 provides a barrier between the bicycle racers and the infield area 12 where spectators may be seated and helps prevent the racers from falling into the infield 12. A similar outer track wall 26 circumscribes the outside of the racing track 22 at the highest inclined edge of the track 22. The outer track wall 26 provides protection for the bicycle racers so that the racers cannot fall off the outside edge of the track 22. The infield track wall 24 and the outer track wall 26 are described in greater detail below.

The portable velodrome 10 also includes a substantially horizontal track segment 28 that circumscribes the infield area 12. The horizontal track segment 28 is positioned between and connected to the infield track wall 24 and the banked racing track 22. The horizontal track segment 28 provides the bicycle racers with an entrance to and an exit from the banked track 22. Before entering the banked track 22, a bicycle racer can obtain a relatively high rate of speed on the horizontal track segment 28. Likewise, when exiting the banked track 22, the bicycle racer can decrease speed while on the horizontal track segment 28.

Figure 2:
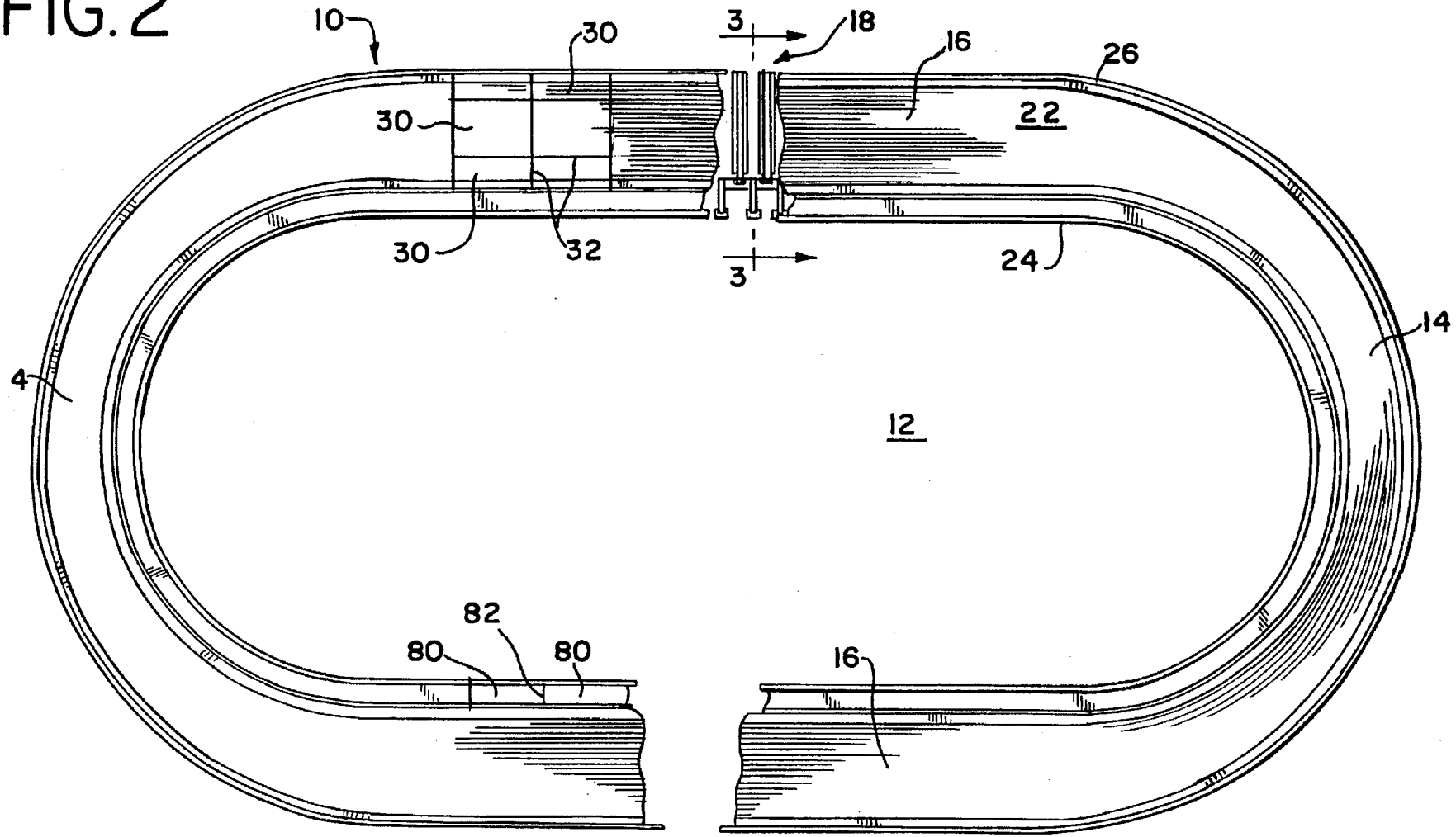
FIG. 2 is a top plan view of the velodrome of FIG. 1 showing a portion of the track surface removed.

FIG. 2 shows a top plan view of the portable velodrome 10 of FIG. 1 in which a portion of the racing track 22 is removed to show the underlying support structure network 18. The racing track 22 has a continuous riding or racing surface around the velodrome 10. The racing track 22 and the racing surface are constructed from multiple, modular track sections 30 in which adjacent track sections abut to form a seam 32 that does not interrupt the racing surface. The outline of six adjacent track sections 30 are shown in FIG. 2. Each individual track section 30 is removably secured to the support structure network 18 as described below in reference to FIGS. 8 and 9.

For reference, each track section 30 has a length dimension along the riding direction of the track 22 and a width dimension along the track 22 incline. All of the track sections 30 are approximately the same width. While, the straight-away 16 track sections 30 are approximately the same length, the turn 14 track sections 30 vary in length to complete the turn 14. The width dimension of each track section are the same. The turn sections 30 vary in length from a relatively longer length at the upper edge 31 to a relatively shorter length at the lower edge 33, as shown in FIG. 7. In FIG. 2, the width of the turns 14 appear to be narrower than the width of the straight-aways 16. However, this is due to the greater degree of incline in the turns 14 than in the straight-aways 16. One portable velodrome 10 made in accordance with the present invention includes 132 track sections 30 which are approximately 5' wide by 12' long. As shown in FIG. 7, the turn sections 30 vary in length from approximately 14' at the upper edge 31 of the upper-most section 30 to approximately 12' at the lower edge 33 of the lower-most section 30. Three track sections 30 are positioned adjacent to each other to define the inclined width of the track 22.

Figures 3, 4, 5, 6:
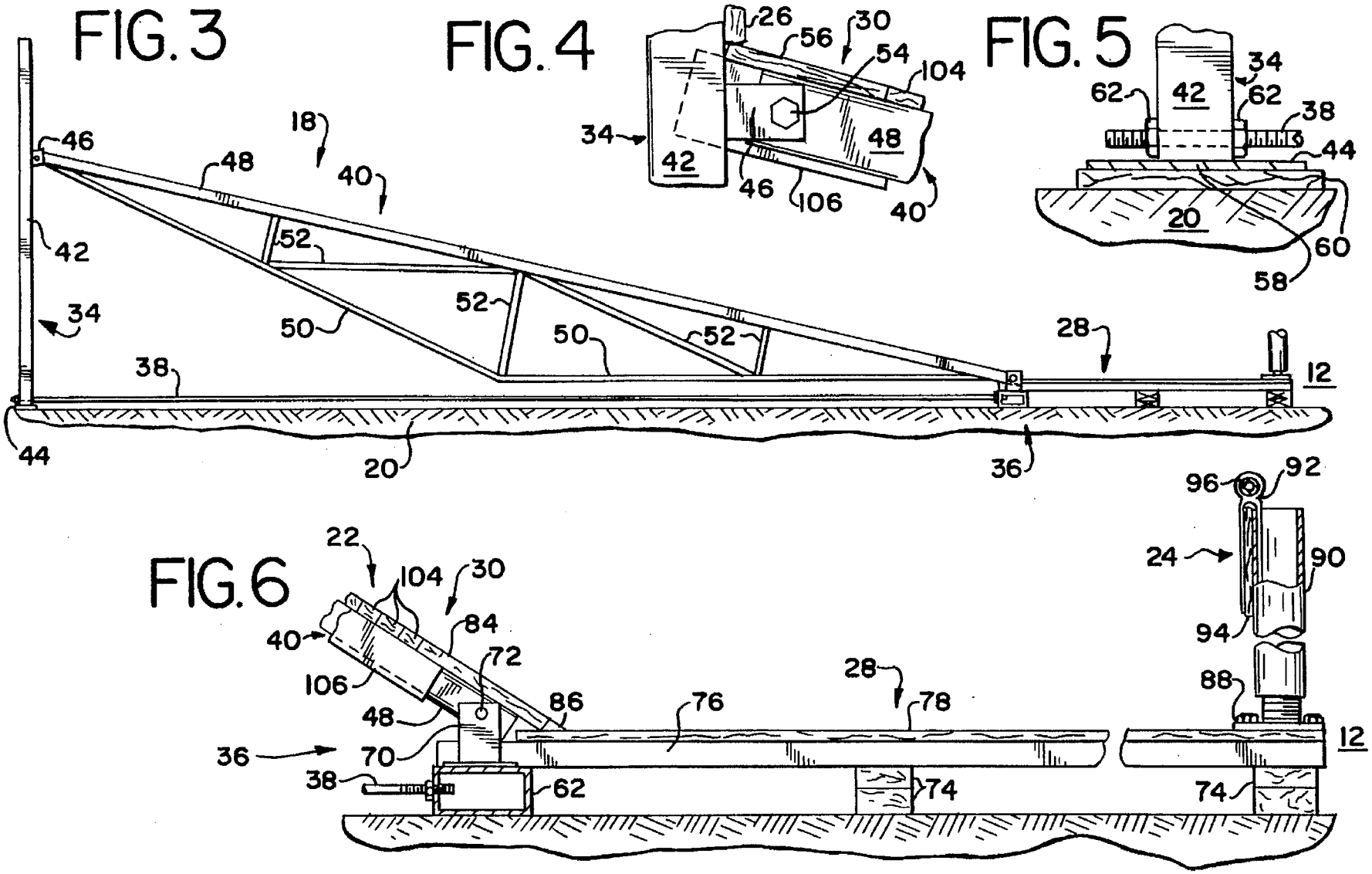
FIG. 3 is a cross-sectional view of the velodrome of FIG. 2 along the line 3—3.
FIG. 4 is an enlarged view of a portion of FIG. 3 showing a support beam connected to an upright post.
FIG. 5 is an enlarged view of a portion of FIG. 3 showing a rod connected to a bottom of the upright post.
FIG. 6 is an enlarged view of a portion of FIG. 3 showing the junction between the banked track and the horizontal track.

FIG. 3 shows a cross-sectional view of the portable velodrome 10 of FIG. 2 along the line 3—3 with the banked racing surface 22 removed. The support structure network 18 of the velodrome includes multiple upright post assemblies 34, an inner rail assembly 36, multiple spacers 38, and multiple support beams 40. The horizontal track segment 28 extends from the inner rail assembly 36 toward the infield area 12. The upright post assembly 34 is spaced apart from the inner rail assembly 36 at a predetermined distance determined by a length of the spacer 38. Alternatively, the upright post assembly 34 could be secured to the horizontal surface 20 and the spacer 38 would not be required. The spacer 38 is shown as a round rod, preferably made of steel, which is removably connected to the upright post assembly 34 and the inner rail assembly 36.

The upright post assembly 34 includes a post 42 extending substantially vertically upward from a post base 44. A support beam connector 46 is attached to the post 42 at a predetermined distance above the post base 44. An outer track wall 26, shown in FIGS. 1 and 2, is removably attached to the top of the post 42 and is similar to the infield track wall 24 as described below in reference to FIG. 6. Referring back to FIG. 3, the height of the support beam connector 46 and the length of the spacer 38 are predetermined such that the support beam 40 and the racing track 22 are at a desired bank or incline.

The support beam 40 is shown as a truss construction and is preferably made from steel components. All of the support beams 40 of the support structure network 18 have the same size dimensions; thus, the support beams 40 are interchangeable with each other. The support beam 40 includes a top beam 48 secured to two bottom legs 50. Various cross legs 52 extend between and are secured to the top beam 48 and the bottom legs 50 for additional structural support. Preferably, the top beam 48 is a hollow square tube and the bottom legs 50 and the cross legs 52 are solid round rods.

FIG. 4 shows an enlarged view of FIG. 3 showing the trussed support beam 40 connected to the upright post 42. Particularly, the top beam 48 is removably and rotatably connected to the support beam connector 46. The support beam connector 46 may be a clevis or U-shaped bracket secured to the post 42. The end of the top beam 48 is positioned within the U of the U-shaped bracket 46 and a removable pin or bolt 54 rotatably attaches the top beam 48 to the U-shaped bracket 46.

FIG. 4 also shows a cross-sectional view of a portion of a track section 30 removably mounted on the support beam 40. The mounting of the track section 30 to the support beam 40 is discussed in detail below in regards to FIGS. 8 and 9. FIG. 4 shows a mounting underblocking 106 behind the top beam 48 of the support beam 40 and a plank 104 on top of the top beam 48. A track strip 56 abuts the last plank 104 at the top edge of the track section 30 and is removably attached to the underblocking 106, 108 of the track section 30. The track strip 56 circumscribes the top edge of all track sections 30 to complete the racing surface at the high edge of the banked track 22. Preferably, the track strip 56 and the outer track wall 26 are made from plywood material. The bottom edge of the outer track wall 26 abuts the track strip 56.

FIG. 5 shows an enlarged view of FIG. 3 showing the post base 44 and the rod 38 connected to the bottom of the upright post assembly 34. The post base 44 is secured to the bottom of the post 42 and provides a stable footing for the upright post assembly 34. The post base 44 may have a hole 58 to allow water to drain from inside the upright post 42 through the post base 44. A leveling block or wedge 60 may be placed underneath the post base 44 to position all post bases 44 horizontally level with each other. The rod 38 is removably attached to the post 42 by extending the rod 38 through holes in the post 42 and securing the rod 38 by nuts 62 threaded onto the rod 38.

Figure 17:
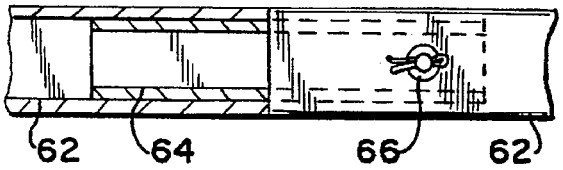
FIG. 17 is a top view of an inner rail connection made in accordance with the principles of the present invention.
Figure 18:
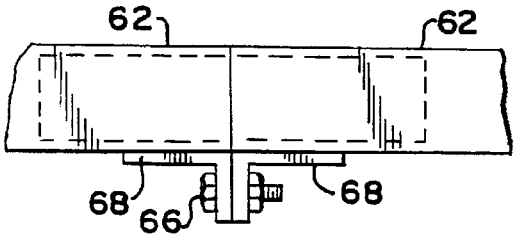
FIG. 18 is a top view of another inner rail connection made in accordance with the principles of the present invention.

FIG. 6 is an enlarged view of a portion of FIG. 3 showing the inner rail assembly 36 and the junction between the banked track 22 and the horizontal track 28. The horizontal track 28 and the infield track wall 24 are also shown in detail. The inner rail assembly 36 includes an inner rail 62 which circumscribes the infield area 12. Preferably, the inner rail 62 is constructed from rectangular tubing segments which are removably joined as shown in FIGS. 17 and 18. In FIG. 17, two inner rail segments 62 are joined by inserting a sleeve 64 inside both of the inner rail segments 62. A fastener 66, such as a pin or bolt, is inserted through holes in one of the inner rail segments 62 and the sleeve 64 to lock the inner rail segment 62 to the sleeve 64. The other inner rail segment 62 may also be pinned to the sleeve 64 or, alternatively, the other inner rail segment 62 can be permanently secured to the sleeve 64. FIG. 18 shows an alternative inner rail 62 connection made in accordance with the principles of the present invention. Brackets 68, such as L-shaped brackets, are secured to both of the inner rail segments 62 by a fastener 66, such as a bolt and nut. A sleeve 64 may also be inserted into the inner rail segments 62 as described above in regards to FIG. 17.

Referring back to FIG. 6, the support beam 40 is removably and rotatably connected to the inner rail assembly 36 by a support beam connector 70. The support beam connector 70 is preferably a U-shaped bracket having a pin or bolt 72 that connects the top beam 48 of the support beam 40 to the inner rail assembly 36. The inner rail segments 62 have a length such that approximately nine or ten support beams 40 are connected to one inner rail segment 62. The spacer rod 38 has a threaded end which is threaded to a nut attached to the inner rail assembly 36.

The horizontal track 28 includes joists 74 circumscribing the infield area 12 at a location inward of the inner rail assembly 36. Substantially horizontal beams 76 are positioned transverse to and on top of the joists 74 and are spaced periodically around the horizontal track 28. One end of the beams 76 is supported by and removably fastened to the inner rail assembly 36. For example, the end of the beam 76 can be pinned or bolted to the inner rail segment 62. Preferably, the beams 76 and joists 74 are constructed from wood material. A horizontal track surface 78, preferably plywood, is attached to the top of the beams 76. The horizontal track 28 may comprise multiple modular, horizontal track sections 80 (shown in outline in FIG. 2) abutted against one another to form seams 82. The horizontal track sections 80 are constructed as described above and have predetermined lengths.

Referring to FIG. 6, the portable velodrome 10 provides a transition surface between the banked track 22 and the horizontal track 28. A transition track strip 84 is removably attached to the underblocking 106, 108 of the track section 30 and circumscribes the horizontal track 28. The construction of the track section 30 is discussed in detail below in reference to FIGS. 8 and 9. The transition track strip 84 abuts the last plank 104 on the lower end of the track section 30 and extends toward the horizontal track 28. A transition wedge strip 86 abuts the transition track strip 84 and the horizontal track 28, particularly the track surface 78, and is removably attached to the horizontal track 28. The transition wedge strip 86 has a triangular cross-sectional shape as shown in FIG. 6. Preferably, the straight-aways 16 have the transition wedge strip 86, and the curves 14 do not, because a bicycle racer typically transitions only in the straight-aways 16. However, the curves 14 may have the transition wedge strip 86 such that the wedge strip 86 circumscribes the horizontal track 28. The transition wedge strip 86 may be positioned in the curves 14 when the curves 14 have a relatively low angle of incline, for example. Preferably, the transition track strip 84 and the transition wedge strip 86 are made from wood material. Accordingly, the portable velodrome 10 provides a transition between the banked track 22 and the horizontal track 28.

The infield track wall 24 is removably attached to the inside edge of the horizontal track 28 and circumscribes the infield area 12. The infield track wall 24 includes wall post bases 88 removably attached to and spaced around the horizontal track 28, and corresponding upright wall posts 90. The upright wall post 90 is a circular, tube which is connected to the wall post base 88 by threads, for example. Handrail clips 92 hold wall sections 94 and a tubular handrail 96 to the upright wall posts 90. The handrail clip 92 is shown in greater detail in FIGS. 11 and 12. The handrail clip 92 includes a tubular handrail holder 98 and a pair of legs 100. The legs 100 extend from the handrail holder 98 and are spaced apart from each other. A hole 102 is provided in one leg 100 of the handrail clip 92. FIGS. 11 and 12 show the handrail 96 extending through the handrail holder 98. Referring to FIG. 6, the wall section 94 is attached to the upright wall post 90 by positioning the wall section 94 against the upright wall post 90. The handrail clip 92 is slid over the wall section 94 and the upright wall post 90 by positioning the leg 100 without the hole 102 on the inside of the upright wall post 90 and positioning the leg 100 with the hole over the wall section 94. The space between the legs 100 of the handrail clip 92 is such that the legs 100 securely grip and hold the wall sections 94 to the upright wall posts 90. A fastener, such as a small nail, may be inserted through the hole 102 in the leg 100 and into the wall section 94 to provide additional holding force.

FIG. 7 shows a perspective view of a turn 14 of the portable velodrome 10 of FIG. 1 showing curved track sections 30. The curved track sections 30 tend to flatten out to form flat, straight track sections 30 when removed from the portable velodrome 10 as described below. Accordingly, the unmounted curved track sections 30 are returned to the curved state by bending the track sections 30 and urging them into position on the support structure network 18 during mounting of the track sections 30.

FIG. 8 shows a back side view of a portion of a flat track section 30 of the portable velodrome 10 of FIG. 1, and FIG. 9 shows a cross-sectional view of two flat track sections 30 abutting one another and mounted on the support beam 40. The track section 30 is removably mounted onto the support beams 40 as described below. The track section 30 includes elongated parallel planks 104 which are abutted tightly adjacent each other and extend lengthwise along the race track 22 riding direction to define the length of the track section 30. Preferably, the planks 104 are made from nominal 1"×2" spruce wood planks 104. The length of the planks 104 are equal to the overall length of the track section 30.

The planks 104 are secured to mounting underblocks 106 and to support underblocks 108. The underblocks 106, 108 extend transverse to the length of the planks 104 on a non-racing side of the track section 30. The underblocks 106, 108 are spaced apart from each other, and are substantially parallel to each other and substantially parallel to the support beams 40. The mounting underblocks 106 are spaced relatively close to each other for mounting the track section 30 to the support beam 40. The track section 30 is removably mounted to the support beam 40, specifically the top beam 48, by bolting flat mounting strips 110 to the mounting underblocks 106. The support underblock 108 is positioned midway between two sets of the mounting underblocks 106. The support underblocks 108 provide additional structural support for the planks 104 and assist in holding the planks 104 tight against each other.

During the initial assembly of a track section 30, the planks 104 are attached to the underblocks 106, 108 by one plank 104 at a time. Fasteners, such as screws or ridged nails for example, can be used to attach the planks 104 to the underblocks 106, 108. A portion of the fasteners, such as a screw head, may be visible on the racing side of the track 22. However, the fastener portion is recessed below the racing surface and is small enough not to interrupt the racing surface. A first plank 104 is placed on the underblocks 106, 108 and attached to the underblocks 106, 108. The next plank 104 is tightly abutted against the previous plank 104 and attached to the underblocks 106, 108. This process is continued until all of the planks 104 are attached to the underblocks 106, 108 to form the track section 30. The completed track section 30 is treated with a fire retardant and a water sealer for protection. As shown in FIG. 8, the planks 104 are substantially parallel to each other. However, as shown in FIG. 7, the planks 104 are bent or curved during assembly to the underblocks 106, 108. After the planks 104 are curved and attached to the underblocks 106, 108, the planks 104 are under tension and attempt to bend back to an un-curved or straight shape. The planks 104 attempt to return to a flat, straight shape because of the resiliency of the wood plank material. Referring back to FIG. 8, in addition to mounting the track sections 30 to the support beams 40, the mounting strips 110 assist in retaining the planks 104 in the curved position.

A wedge block 112 may be abutted against a bottom leg 50 or a cross leg 52 of the support beam 40 and removably attached to the support underblocks 106. The wedge block 112 provides additional assistance in retaining the planks 104 in the curved positions. The wedge blocks 112 are placed throughout the support structure network 18 as needed and particularly at the top ends of a track section 30 and in the curved track sections 30.

Referring to the cross-sectional view of FIG. 9, two track sections 30 are shown abutting each other over the top beam 48 of the support beam 40. The abutting edge of each track section 30 includes only one mounting underblock 106. Accordingly, when the two track sections 30 are placed on the support beam 40, the joint 32 between the track sections 30 overlaps the top beam 48. On the racing side of the track sections 30, the joint 32 is a transition between the two track sections 30 that does not interrupt the racing surface. The mounting strip 110 is removably attached to the mounting underblocks 106 of each track section 30.

FIG. 9 also shows the mounting strip 110 removably attached to the mounting underblocks 106 in greater detail. An internally threaded sleeve or nut 114 is positioned within a recess 116 on the plank side of the mounting underblock 106. The sleeve 114 is inserted into the recess 116 prior to attachment of the planks 104 to the underblocks 106, 108. A fastener or bolt 118 is inserted through a hole in the mounting strip 110, through a hole in the mounting underblock 106, and lockingly or threadingly engaged with the sleeve 114. In this manner, the sleeve 114 and the bolt 118 do not protrude through the planks 104. Further, the sleeve 114 is recessed within the mounting underblock 106 rather than recessed within the plank 104 on the racing side of the plank 104. This construction obviates the need for recesses on the racing surface of the planks 104 and corresponding plugs to fill and smooth the plank recesses. The racing surface is free of any elements that mount the track sections 30 to the inclined beams 40. Accordingly, the modular track sections 30 are removably mounted on the inclined beams 40 without interrupting the racing surface.

FIG. 13 shows a side elevational view of a spacer rod 120 connected to an upright post assembly 122 and an inner rail assembly 124 in accordance with the principles of the present invention. The spacer rod 120 includes a straight midsection 126 and two opposite, bent ends 128 extending downward from the midsection 126. A rod connector 130 is attached to the upright post assembly 122, particularly the post 42, and a corresponding rod connector 130 is attached to the inner rail assembly 124, particularly the inner rail segment 62. Each rod connector 130 has a hole for receiving the end 130 of the rod 120. In this manner, the upright post assembly 122 is easily spaced apart at a predetermined distance from the inner rail assembly 124 by placing the ends 128 of the spacer rod 120 in the holes of the rod connectors 130.

FIG. 14 shows a top view of a spacer rod 132 connected to an upright post assembly 134 and an inner rail assembly 136 in accordance with the principles of the present invention. The spacer rod 132 is a straight rod having threaded ends 138 with two nuts 140 on each end. A rod connector 142 is attached to the upright post assembly 134, particularly the post base 44, and a corresponding rod connector 142 is attached to the inner rail assembly 136, particularly the inner rail segment 62. Each of the rod connectors 142 has a wall 144 that has a U-shaped slot for receiving the rod 132. The U-shaped slot opens upward as shown in the top view of FIG. 14. The ends 138 of the spacer rod are placed in the U-shaped slots of the rod connectors 142 with the nuts 140 on either side of the wall 144 and the nuts 140 are tightened. In this manner, the upright post assembly 134 is easily spaced apart at a predetermined distance from the inner rail assembly 136.

Figure 10:
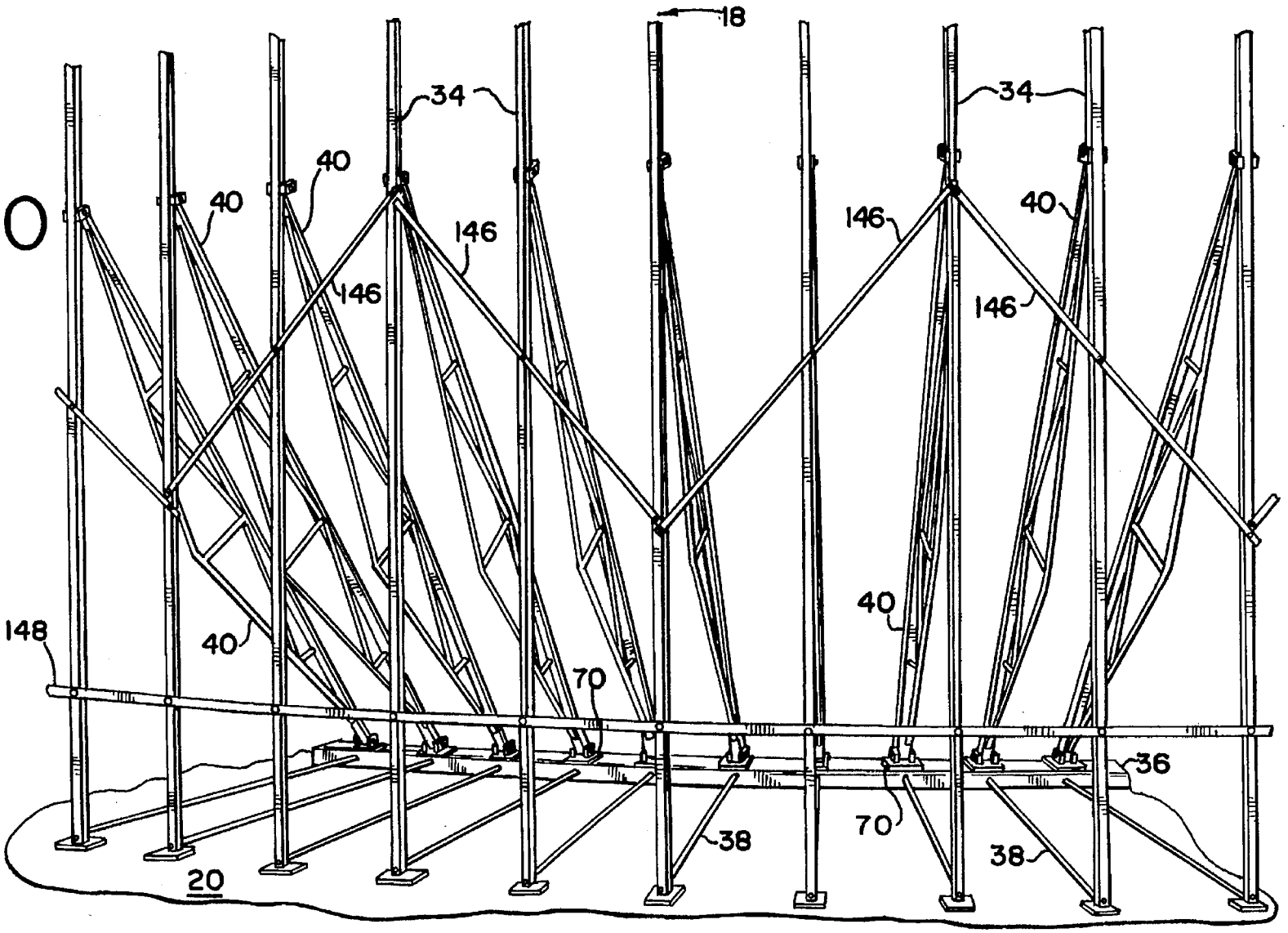
FIG. 10 is an off side elevational view of a portion of the velodrome of FIG. 1.

FIG. 10 shows an outside elevational view of a portion of the portable velodrome 10 of FIG. 1. Particularly, FIG. 10 shows the support structure network 18 including a plurality of support beams 40 connected to the inner rail assembly 36 and to a plurality of upright post assemblies 34. Cross braces 146 are removably attached, by bolts for example, to the upright post assemblies 34 in a "zig zag" type pattern. Preferably, the cross braces 146 are made from so called "angle iron" type material; however, the cross braces 146 could be made from other materials. A flat band brace 148 circumscribes the outside of the upright post assemblies 34 and is removably attached to the upright post assemblies 34. The cross braces 146 and the band brace 148 provide additional structural support and stability to the support structure network 18.

Figure 15:
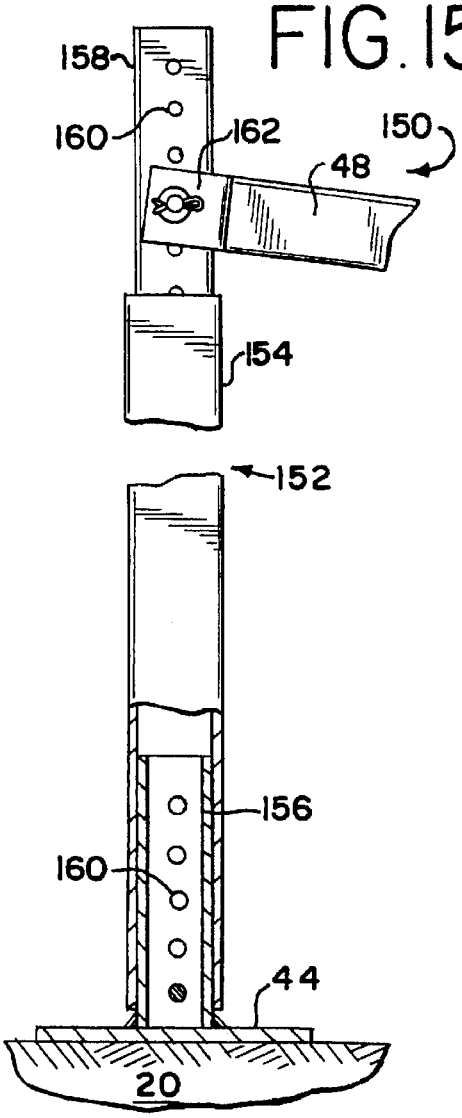
FIG. 15 is a side elevational view of a telescoping upright post made in accordance with the principles of the present invention.

FIG. 15 shows a side elevational view of an upright post assembly 150 made in accordance with the principles of the present invention. Particularly, the upright post assembly 150 includes a telescoping post 152 attached to a post base 44 and has an adjustable height. The telescoping post 152 includes an outside post 154, a lower inside post 156, and an upper inside post 158. The lower inside post 156 is attached to the post base 44 and the outside post 154 is vertically slidable on the outside of the lower inside post 156. The upper inside post 158 is vertically slidable within the outside post 154. Holes 160 are provided through the upper and lower inside posts 158, 156 and the outside post 154. The outside post 154 is slid vertically in relation to the lower inside post 156 to align corresponding holes 160 through the posts 154, 156. A pin or bolt, for example, is inserted through the holes 160 to secure the outside post 154 to the lower inside post 156. Likewise, the outside post 154 is secured to the upper inside post 158 by inserting a pin through aligned holes 160.

Figure 16:
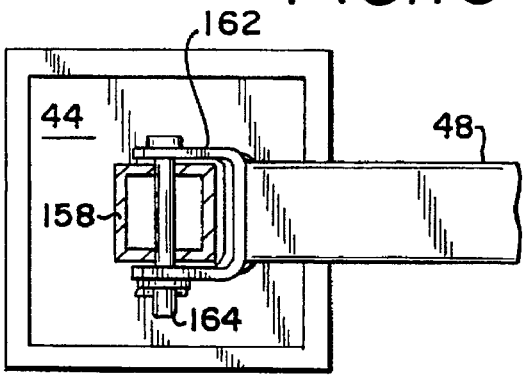
FIG. 16 is a cross-sectional view of a pin connection of FIG. 15.

As shown in FIGS. 15 and 16, a U-shaped connector 162 is attached to the top beam 48 of the trussed support beam 40. The U-shaped connector 162 has holes through both legs of the U that are aligned with the holes 160 in the upper inside post 158. A pin or bolt 164 is inserted through the aligned holes to removably and rotatably secure the support beam 40 to the upper inside post 158. During assembly of the portable velodrome 10, the height of the telescoping upright post assembly 150 can be adjusted by sliding and securing the posts 154, 156, 158 with pins to achieve the desired height. The lower inside post 156 can be adjusted to provide for horizontal leveling of the upright post assemblies 150. The upper inside post 158 can be adjusted to provide the desired height of the support beam 40 and thus, the corresponding degree of race trace banking. In this manner, the telescoping post assemblies 150 are interchangeable and any given post assembly 150 can be utilized at any location on the velodrome 10.

Figure 19:
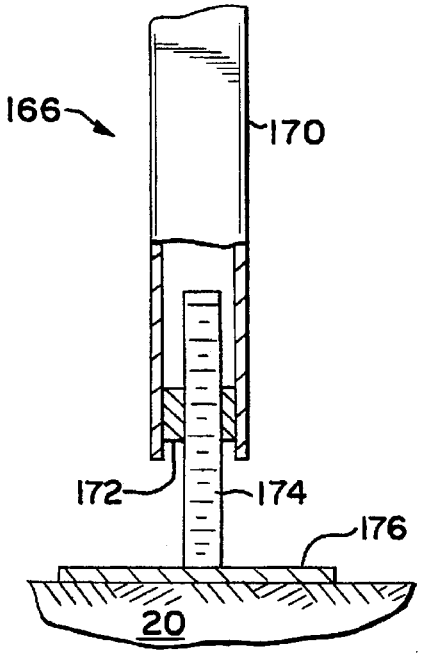
FIG. 19 is a side elevational view of an upright post assembly having a vertically adjustable leveling base made in accordance with the principles of the present invention.

FIG. 19 shows a side elevational view of an upright post assembly 166 having a vertically adjustable leveling base 168 made in accordance with the principles of the present invention. The upright post assembly 166 includes a substantially vertical upright 170 having a threaded portion 172. The threaded portion 172 may be an internally threaded plate attached to the upright 170, for example. The leveling base 168 has an externally threaded rod 174 extending substantially vertically upward from a base plate 176. The rod 174 threadingly engages the threaded portion 172 of the upright 170. As the leveling base 168 is rotated, the base plate 176 moves closer to or further away from the upright 170. Accordingly, the upright post assembly 166 is vertically adjustable to level the upright post assembly 166.

The portable velodrome 10 is assembled by first selecting a substantially flat, horizontal surface 20 in which to position the velodrome 10. Referring to FIG. 3, the inner rail assembly 36 is assembled by connecting the inner rail segments 62 which circumscribe the infield area 12. The inner rail assembly 36 is leveled horizontally by placing wedges underneath the inner rail assembly 36 where required. The support beams 40 are connected to the inner rail assembly 36 and to the upright post assemblies 34. The spacer rods 38 are connected to the inner rail assembly 36 at appropriate locations depending on the length of the rod 38 and the desired degree of track banking. The upright post assemblies 34 are positioned upright and at the appropriate distance from the inner rail assembly 36. The upright post assemblies 34 are leveled horizontally with respect to the inner rail assembly 36. The upright post assemblies 34 are also leveled vertically. The spacer rods 38 are connected to the upright post assemblies 34 to maintain the spaced apart distance from the inner rail assembly 36. As shown in FIG. 10, the cross braces 146 and the flat band brace 148 are connected to the upright post assemblies 34 to provide additional structural stability.

Referring to FIGS. 8 and 9, the track sections 30 are positioned on the support beams 40 and secured to the support beams 40 by the mounting strips 110. Before the track sections 30 are mounted onto the support beams 40 the track sections 30, including the turn track sections 30, are substantially flat. As the track sections 30 are urged into position, the track sections 30, particularly the turn track sections 30, may take on a curved shape. Accordingly, the wedge blocks 112 are positioned against the bottom legs 50 or cross legs 52 of the support beams 40 and attached to the track sections 30 as needed to hold the track sections 30 in place.

Referring to FIGS. 2 and 6, the horizontal track sections 80 are positioned on the surface 20 and leveled in reference to the inner rail assembly 36. The transition track strip 84 is attached to the banked track section 30 and the transition wedge strip 86 is attached to the horizontal track section 80. The infield wall 24 is assembled on the horizontal track 28 as described above.

Referring to FIG. 4, the track strip 56 and the outer track wall 26 are assembled as described above.

Referring to FIG. 10, a numbering system can be utilized to improve the efficiency of assembling the portable velodrome 10. For example, a unique number can be assigned to and marked on each combination of upright post assembly 34, spacer rod 38, and infield rail support beam connector 70. Thus, during assembly of the portable velodrome 10, the velodrome components can be quickly assembled by matching the numbers. The banked track segments 30, the horizontal track segments 80, and other components can also be numbered to promote efficient assembly of the portable velodrome 10. Of course, components that are interchangeable, such as the telescoping upright post assembly 150 and the support beams 40, need not be numbered.

During disassembly of the portable velodrome 10, the assembly procedure is merely reversed. The construction of the banked track sections 30 allows the curved track sections 30 to flatten out when removed from the support beams 40. The flattened track sections 30 are substantially easier to handle, transport, and store.

A portable velodrome 10 made in accordance with the principles of the present invention can be transported on three flatbed trailers and assembled in approximately 15 hours by 10 laborers. Accordingly, the present invention provides a portable velodrome 10 that can be assembled, disassembled, transported, and reassembled quite easily and efficiently.

While the preferred embodiments have been illustrated and described, numerous changes and modifications can be made without significantly departing from the spirit and scope of this invention. Therefore, the inventors intend that such changes and modifications be covered by the appended claims.

We claim:

1. A portable track comprising:

a support structure network comprising an inner rail positioned at a lower, inner end of the support structure network, a plurality of upright posts spaced apart from the inner rail at a predetermined distance, and, a plurality of support beams removably connected to the inner rail and the upright posts; and, a plurality of modular track sections removably mounted to the support structure network to define a track surface.

2. The portable track of claim 1 wherein the track surface forms a circuitous circuit.

3. The portable track of claim 2 wherein the track surface is generally oblong circular having opposed turns connected by straight-aways.

4. The portable track of claim 3 wherein the track surface has inner and outer portions and the track surface is inclined at an angle upward from the inner portion of the track surface to the outer portion of the track surface to define a banked portion of the track surface.

5. The portable track of claim 4 wherein the angle of the incline of the track surface is adjustable.

6. The portable track of claim 4 wherein the turns have a greater angle of incline than the straight-aways.

7. The portable track of claim 6 wherein the turns have an angle of incline of at least 40° and the straight-aways have an angle of incline of at least 10°.

8. The portable track of claim 4 further comprising a horizontal portion adjacent the inner portion of the banked portion of the track surface.

9. The portable track of claim 8 further comprising a transition surface between the banked portion and the horizontal portion.

10. The portable track of claim 1 wherein the upright posts extend substantially vertically upward.

11. A track comprising:

a support structure network adapted to at least partially circumscribe an infield area;

a plurality of track sections removably mounted on the support structure network to form a banked portion;

a substantially horizontal portion extending from a bottom of the banked portion;

a transition portion between the banked portion and the horizontal portion;

an outer track wall circumscribing an upper, outer edge of the banked portion, the outer track wall comprising a plurality of outer track wall sections removably attached to the banked portion; and, an infield track wall circumscribing an inside edge of the horizontal portion, the infield track wall comprising a plurality of infield track wall sections removably attached to the horizontal portion.

12. The track of claim 11 wherein the transition portion comprises:

a first transition portion removably attached to the banked portion, the first transition portion abutting the track sections and extending toward the horizontal portion; and, a second transition portion removably attached to the horizontal portion, the second transition portion abutting the first transition portion and the horizontal portion.

13. The track of claim 12 wherein the second transition portion is a wedge strip having a triangular cross-sectional shape.

14. The track of claim 11 wherein each of the track sections comprises:

a plurality of elongated planks, each plank abutted tightly to an adjacent plank, the planks extending lengthwise to define a length of the track section; and, a plurality of underblocks positioned transverse to the planks on a non-racing side of the track section, the planks attached to the underblocks.

15. The track of claim 14 wherein at least two underblocks are spaced relatively close to each other to define mounting underblocks for mounting the track section to the support structure network.

16. The track of claim 15 wherein the support structure network comprises a support beam positioned between the mounting underblocks, and wherein the track further comprises a mounting strip removably secured to the mounting underblocks to removably mount the track sections to the support beam.

17. The track of claim 16 wherein each of the mounting underblocks define a recess adjacent the plank, and wherein the track comprises:

a sleeve positioned within each recess; and, a fastener extending through the mounting strip and through the mounting underblock to lockingly engage the sleeve.

18. The track of claim 10 wherein the support structure network comprises:

an inner rail positioned at a lowest end of the banked portion;

a plurality of upright posts spaced apart from the inner rail at a predetermined distance; and, a plurality of support beams removably and rotatably connected to the inner rail and the upright posts.

19. The track of claim 18 wherein the upright posts are spaced apart from the inner rail by a plurality of spacers that are removably connected to the upright posts and the inner rail.

20. The track of claim 19 wherein each spacer has two threaded ends in which one end is threadingly engaged with the inner rail and the other end is threadingly engaged with the upright post.

21. The track of claim 19 wherein each upright post and the inner rail have a rod connector having a hole, and wherein each spacer has two bent ends which are inserted into the holes of the rod connectors.

22. The track of claim 19 wherein each upright post and the inner rail have a rod connector having a U-shaped slot, and wherein the ends of the spacer are positioned within the U-shaped slot.

23. The track of claim 18 wherein the inner rail comprises a plurality of inner rail segments removably connected together by a sleeve inserted into adjacent inner rail segments.

24. The track of claim 18 wherein the inner rail comprises a plurality of inner rail segments removably connected together by a bracket on each inner rail segment that is fastened to a corresponding bracket on an adjacent inner rail segment.

25. The track of claim 18 wherein the upright post comprises a support beam connector attached to the upright post at a predetermined distance above a post base.

26. The track of claim 26 wherein the upright post is a telescoping post having an adjustable height.

27. The track of claim 26 wherein the telescoping post comprises:

a first post attached to a post base;

a second post vertically slidable in relation to the first post; and, a third post vertically slidable in relation to the second post.

28. The track of claim 18 wherein the upright post comprises:

a substantially vertical upright having a threaded portion; and, a base having a threaded rod extending substantially vertically upward from the base, the rod being in threaded engagement with the threaded portion of the upright.

29. The track of claim 18 wherein the support beam comprises:

a top beam secured to two bottom legs; and, at least one cross leg secured to the top beam and one of the bottom legs.

30. The track of claim 18 wherein the support structure further comprises:

a plurality of cross braces removably attached to the upright posts; and, a flat band brace circumscribing the outside of the upright posts and removably attached to the upright posts.

31. The track of claim 11 further comprising a plurality of wall posts extending upward from the upper, outer edge of the banked portion and upward from the inside edge of the horizontal portion, and wherein the outer track wall sections and the infield track wall sections are attached to the wall posts by handrail clips.

32. The track of claim 31 wherein the handrail clip comprises a handrail holder and a pair of spaced apart legs extending from the handrail holder, and wherein the wall section is attached to the wall post by positioning one leg inside the wall post and positioning the other leg over the wall section.

* * * * *

UNITED STATES PATENT AND TRADEMARK OFFICE

CERTIFICATE OF CORRECTION

PATENT NO. : 5,660,595

DATED : August 26, 1997

INVENTOR(S) : Peter A. Ferro, Jr., John C. Vande Velde, Robert J. Sutphen, Valere F. Vande Velde, Robert Jensen and Cecil R. Behringer.

It is certified that error appears in the above-identified patent and that said Letters Patent is hereby corrected as shown below:

The Field of Invention was omitted. Please insert the following as the Field of Invention:

This invention generally relates to sports racing tracks. More specifically, this invention relates to portable and expandable tracks or bicycle racing velodromes that can be used indoors and outdoors.

In the Claims:

Col. 12, line 21, delete "Claim 10" and insert therefor "Claim 11".

Col. 12, line 57, delete "Claim 26" and insert therefor "Claim 18".

Col. 2, line 20, delete "off" and insert therefor "out".

Signed and Sealed this

Tenth Day of March, 1998

Bruce Lehman

*Attest:*

BRUCE LEHMAN

*Attesting Officer*

*Commissioner of Patents and Trademarks*